US011117024B2

(12) United States Patent
Behera et al.

(10) Patent No.: US 11,117,024 B2
(45) Date of Patent: Sep. 14, 2021

(54) SMART BALL

(71) Applicant: Dev Behera, Dhenkanal (IN)

(72) Inventors: Dev Behera, Dhenkanal (IN); Siddharth George, Singapore (SG)

(73) Assignee: Dev Behera, Dhenkanal (IN)

( * ) Notice: Subject to any disclaimer, the term of this patent is extended or adjusted under 35 U.S.C. 154(b) by 0 days.

(21) Appl. No.: 17/019,587

(22) Filed: Sep. 14, 2020

(65) Prior Publication Data

US 2020/0406107 A1 Dec. 31, 2020

Related U.S. Application Data

(63) Continuation of application No. PCT/IN2018/050339, filed on May 28, 2018.

(30) Foreign Application Priority Data

Mar. 14, 2018 (IN) ..... 201831009261

(51) Int. Cl.
*A63B 43/00* (2006.01)
*A63B 37/06* (2006.01)
(Continued)

(52) U.S. Cl.
CPC ..... *A63B 43/00* (2013.01); *A63B 37/06* (2013.01); *A63B 37/12* (2013.01);
(Continued)

(58) Field of Classification Search
CPC ..... A63B 43/00; A63B 37/06; A63B 37/12; A63B 69/0015; A63B 2037/065;
(Continued)

(56) References Cited

U.S. PATENT DOCUMENTS 4,775,948 A * 10/1988 Dial ..... A63B 43/00 368/250
5,251,903 A * 10/1993 Bixler ..... A63B 43/00 473/140

(Continued)

FOREIGN PATENT DOCUMENTS

GB 2538496 11/2016

OTHER PUBLICATIONS

WIPO, International Search Report in corresponding PCT application PCT/IN2018/050339, dated Nov. 28, 2018.

(Continued)

*Primary Examiner* — Steven B Wong
(74) *Attorney, Agent, or Firm* — Ryan Alley IP

(57) ABSTRACT

A smart ball (100) comprising: an inner sphere portion (12) consisting of a cork like material and an outer sphere (19) that ensconces said inner sphere, said inner sphere further comprising: a cylindrical cavity (14), located substantially at the core of said ball, said cavity formed by drilling into said cork from an operative top side; a sensor assembly (16) placed in the centre of said cylindrical cavity along a reference plane defined by a locus of points wherein said points being collinear points running from a first end of said seam (18) to a second end of said seam, thereby ensuring that orthogonal measurements of said sensor assembly being aligned with orthogonal axes of said ball; and a charging port on said seam, said charging port connected to a battery placed in said cylindrical cavity and said battery connected to said sensor assembly.

20 Claims, 10 Drawing Sheets

(51) Int. Cl.
*A63B 37/12* (2006.01)
*A63B 69/00* (2006.01)

(52) U.S. Cl.
CPC ..... *A63B 69/0015* (2013.01); *A63B 2037/065* (2013.01); *A63B 2037/125* (2013.01); *A63B 2220/36* (2013.01); *A63B 2220/44* (2013.01); *A63B 2220/803* (2013.01); *A63B 2220/833* (2013.01); *A63B 2225/50* (2013.01)

(58) Field of Classification Search
CPC ..... A63B 2037/125; A63B 2220/36; A63B 2220/44; A63B 2220/803; A63B 2220/833; A63B 2225/50; A63B 2102/20; A63B 37/02; A63B 43/004; A63B 2209/00; A63B 45/00
See application file for complete search history.

(56) References Cited

U.S. PATENT DOCUMENTS 5,526,326 A * 6/1996 Fekete ..... A63B 43/00 368/10
5,761,096 A * 6/1998 Zakutin ..... A63B 43/00 368/2
8,864,609 B2 * 10/2014 Kodama ..... A63B 43/06 473/570
9,526,951 B1 * 12/2016 Ganson ..... A63B 24/0062
10,159,874 B1 * 12/2018 Lin ..... A63B 37/02
10,742,475 B2 8/2020 Lai et al.
2005/0043125 A1 * 2/2005 Nakano ..... A63H 33/18 473/571
2006/0105857 A1 * 5/2006 Stark ..... A63B 43/00 473/353
2008/0015064 A1 * 1/2008 Nelson ..... A63H 5/00 473/571
2012/0255998 A1 * 10/2012 Luciano, Jr. ..... A63B 43/00 235/439
2012/0255999 A1 * 10/2012 Luciano, Jr. ..... B29C 43/18 235/439
2014/0277636 A1 * 9/2014 Thurman ..... A63B 69/0002 700/91
2015/0159846 A1 * 6/2015 Hollinger ..... A63B 43/06 362/183
2016/0354666 A1 * 12/2016 Greenwalt ..... A63B 71/0619
2017/0282039 A1 * 10/2017 Meredith ..... G06Q 10/10
2018/0193696 A1 * 7/2018 Gwydir ..... A63B 24/0062
2019/0168081 A1 * 6/2019 Tattersfield ..... A63B 37/0075
2020/0353318 A1 * 11/2020 Tsutsumi ..... A63B 43/004
2020/0384318 A1 * 12/2020 Komatsu ..... A63B 37/0056
2021/0055107 A1 * 2/2021 Murarka ..... G01P 15/14

OTHER PUBLICATIONS

WIPO, Written Opinion of the ISA in corresponding PCT application PCT/IN2018/050339, dated Nov. 28, 2018.

* cited by examiner

SMART BALL

RELATED APPLICATIONS

This application claims priority under 35 U.S.C. § 120 to, and is a continuation of, co-pending International Application PCT/IN2018/050339, filed May 28, 2018 and designating the US, which claims priority to IN Application 201831009261, filed Mar. 14, 2018, such IN Application also being claimed priority to under 35 U.S.C. § 119. These IN and International applications are incorporated by reference herein in their entireties.

BACKGROUND

Field

This invention relates to the field of sports equipment. Particularly, this invention relates to a smart ball.

Wearable sensors have been widely used in medical sciences, sports and security. Wearable sensors can detect abnormal and unforeseen situations, and monitor physiological parameters and symptoms through these trackers. Wearable sensors have enhanced healthcare service delivery by allowing continuous monitoring of patients without hospitalization. Medical monitoring of patients' body temperature, heart rate, brain activity, muscle motion and other critical data can be delivered through these trackers. In sports there is an increasing demand for wearable sensors as seen in the large number of consumer oriented fitness devices available.

Technology supporting the monitoring of personal activity is being more widely deployed. Wearable sensors are being used in health and medical sciences to monitor patients and in sports for tracking personal activity. Fitness trackers that are devices or applications or a combination of both, are used for monitoring and tracking personal fitness related metrics such as distance travelled, calories consumed and heartbeat. These fitness trackers are widely available and increasing used and is enabling a personal fitness interest.

While personal fitness devices and tools are commonly available, the same is not true with respect to tools or equipment to support sports related performance monitoring and improvement. This is true both in the case of individual sports like tennis and badminton and in team sports like cricket. The tools that are available in this sphere typically require sophisticated setup and technology. Know-how of this technology is difficult, very expensive, and not readily available to an average sports enthusiast. This is especially true of cricket where the performance monitoring and improvement tools are only available to top cricketers.

While technology has become an integral part of performance monitoring and improvement at the highest levels of sport, lower levels of sports are lacking in affordable technology enabled tools and devices to support performance improvement.

Sports' coaching is technology-starved at lower levels of the sport. Coaches do not have access to easy to use tools and technology to measure metrics such as bowling speed and are dependent on personal intuition for performance monitoring and management.

Therefore, there is a need for a cost-effective solution that supports stakeholders in the coaching and performance improvement ecosystem at lower levels of cricket.

SUMMARY

An object of the invention is to provide a ball with an embedded sensor.

Another object of the invention is to provide a smart ball for gathering statistics and performance improvement.

Yet another object of the invention is to provide a ball with an embedded sensor without affecting the normal performance of the ball.

According to this invention, there is provided a smart ball comprising:

- an inner sphere;
- an outer sphere that ensconces said inner sphere, said outer sphere comprising at least two halves stitched together to form a seam so as to completely cover said inner sphere, said inner sphere further comprising:
  - a cylindrical cavity, running through a central core of said smart ball, said cylindrical cavity formed by drilling into said inner sphere from an operative top side; and
  - a sensor assembly placed, substantially, at the centre of said cylindrical cavity, along a reference plane defined by a locus of points wherein said points being collinear points running from a first end of said seam to a second end of said seam, thereby ensuring that orthogonal measurements of said sensor assembly are aligned with orthogonal axes of said smart ball.

According to this invention, there is also provided a smart ball comprising:

- an inner sphere;
- an outer sphere that ensconces said inner sphere, said outer sphere comprising at least two halves stitched together to form two spaced apart seams so as to completely cover said inner sphere, said inner sphere further comprising:
  - a cylindrical cavity, running through a central core of said smart ball, said cylindrical cavity formed by drilling into said inner sphere from an operative top side; and
  - a sensor assembly placed, substantially, at the centre of said cylindrical cavity, along a reference plane that divides the two seams in order for them to be equidistant from an imaginary line which form the plane when extended through the mass of the ball, thereby ensuring that orthogonal measurements of said sensor assembly are aligned with orthogonal axes of said smart ball.

In at least an embodiment, a charging port on said seam, said charging port connected to a battery placed in said cylindrical cavity and said battery connected to said sensor assembly.

In at least an embodiment, said inner sphere portion is filled with a cork like material.

In at least an embodiment, said seam circumferentially enveloping said smart ball.

In at least an embodiment, said sensor assembly is secured in said cavity by means of potting, by a potting material, in order to absorb vibrations and thermal shocks, in that, said potting material being equivalent in weight to material that was removed from said inner sphere.

In at least an embodiment, said cylindrical cavity is filled with a liquid mix of thermal encapsulant that cures over time to become solid silicone elastomer.

In at least an embodiment, said cylindrical cavity is filled with solid material selected from a group of materials consisting of high-density foam, rubber, and wood shavings.

In at least an embodiment, said sensor assembly comprises at least a motion-capture mechanism, wherein:

- a first axis of said motion-capture mechanism passing through a centre of said cylindrical cavity;

a second axis of said motion-capture mechanism being perpendicular to said plane defined by said locus of points; and a third axis of said motion-capture mechanism passing through a centre of said sphere and parallel to said plane defined by said locus of points.

In at least an embodiment, said sensor assembly comprises at least one mechanism selected from a group of mechanisms consisting of accelerometers, gyroscopes, and magnetometers, wherein:

a first axis of said motion-capture mechanism passing through a centre of said cylindrical cavity;

a second axis of said motion-capture mechanism being perpendicular to said plane defined by said locus of points; and a third axis of said motion-capture mechanism passing through a centre of said sphere and parallel to said plane defined by said locus of points.

In at least an embodiment, said sensor assembly being communicably coupled to a microcontroller, located within said ball, wherein:

a first axis of said microcontroller passing through a centre of said cylindrical cavity;

a second axis of said microcontroller being perpendicular to said plane defined by said locus of points; and a third axis of said microcontroller passing through a centre of said sphere and parallel to said plane defined by said locus of points.

In at least an embodiment, said sensor assembly being communicably coupled to a wireless antenna, located within said ball, wherein:

a first axis of said antenna passing through a centre of said cylindrical cavity;

a second axis of said antenna being perpendicular to said plane defined by said locus of points; and a third axis of said antenna passing through a centre of said sphere and parallel to said plane defined by said locus of points.

In at least an embodiment, said sensor assembly said sensor assembly being communicably coupled to a memory storage, located within said ball, wherein:

a first axis of said memory storage passing through a centre of said cylindrical cavity;

a second axis of said memory storage being perpendicular to said plane defined by said locus of points; and a third axis of said memory storage passing through a centre of said sphere and parallel to said plane defined by said locus of points.

In at least an embodiment, said sensor assembly comprises a microcontroller communicably coupled with a clock for recording sensed events, said clock being also communicably coupled to another remote sensor assembly to record said another remote sensor assembly's sensed events with respect to the same clock in order to provide a single-clock session of sensed events comprising data from said ball's sensor assembly in synchronisation with data from said another remote sensor assembly.

BRIEF DESCRIPTION OF THE DRAWINGS

The invention will now be described in relation to the accompanying drawings, in which.

DETAILED DESCRIPTION

According to this invention, there is provided a smart ball (100).

The invention covers a sports device such as a ball that is embedded with sensors configured to measure spin, acceleration, orientation, velocity, and other motion parameters of the ball. The ball includes electronics in a custom integrated circuit board and housed within the ball. The housing and electronics embedded in the housing are so constructed as to not impact the size, weight, and other characteristics of the ball. The initial processing of the data stream generated is accomplished in the housed integrated circuit board. The pre-processed data stream generated is transmitted to be analysed by processing algorithms.

Figure 1:
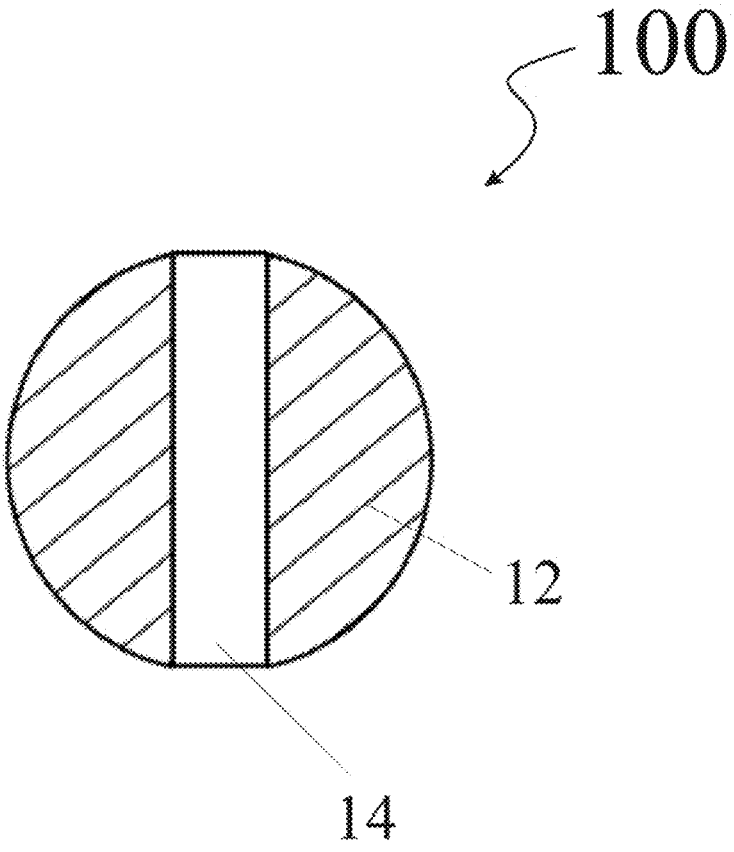
FIG. 1 is an illustrative diagram of a ball with the cavity shown.

FIG. 1 is an illustrative diagram of a ball with the cavity shown.

Figure 2:
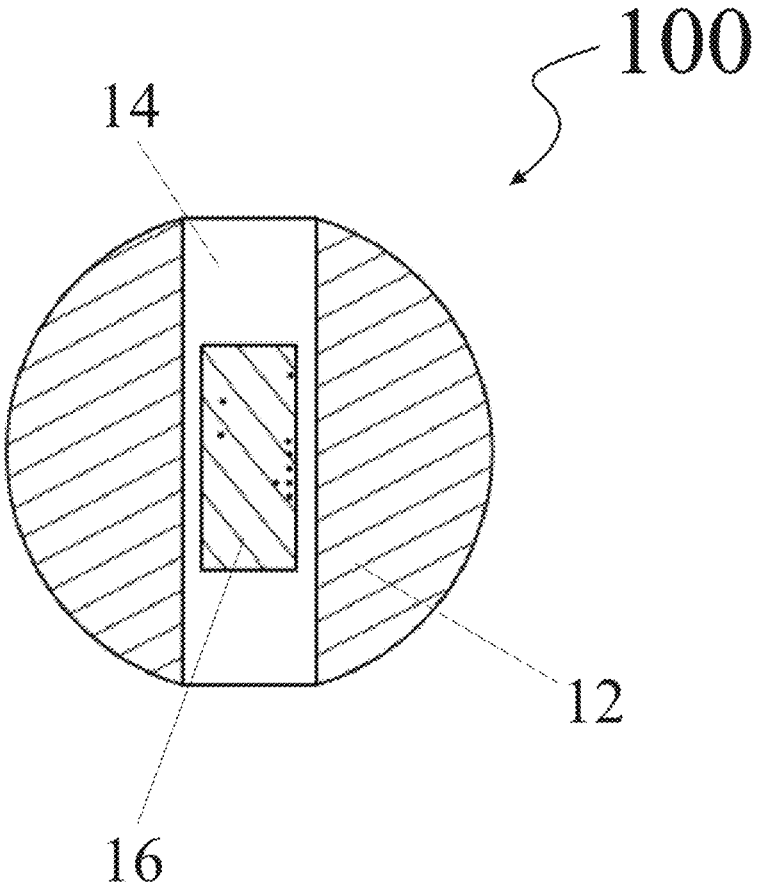
FIG. 2 is an illustrative diagram of a ball with the sensor assembly embedded in the cavity created in the ball.

FIG. 2 is an illustrative diagram of a ball with the integrated circuit board embedded in the cavity created in the ball.

Figure 3:
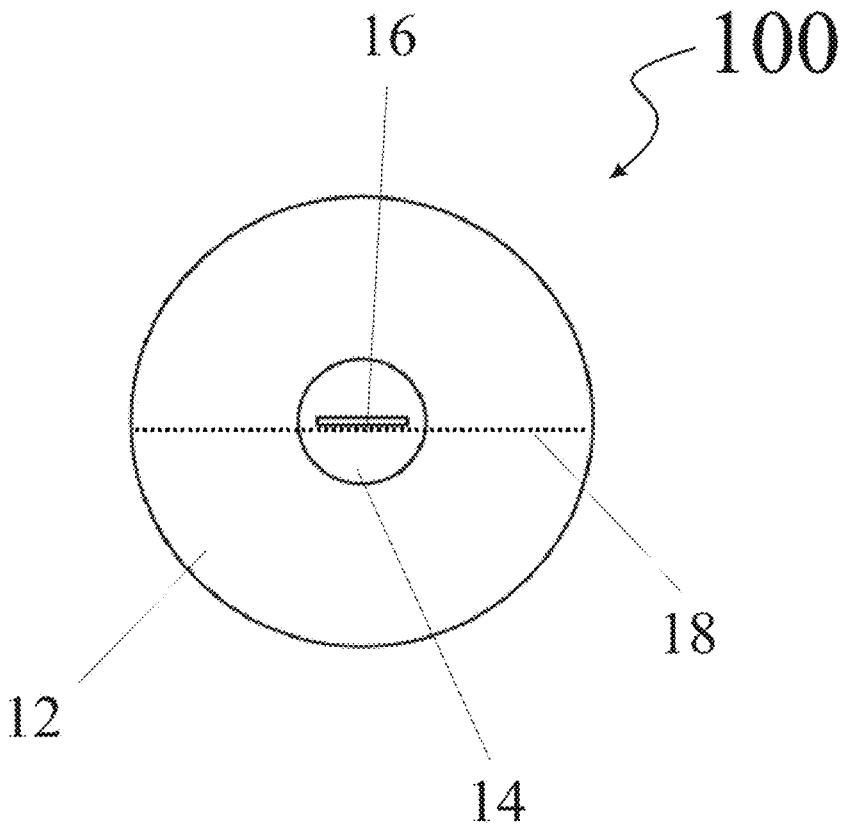
FIG. 3 is an illustrative diagram of a ball with the sensor assembly alignment with the "seam"

FIG. 3 is an illustrative diagram of a ball with the sensor assembly alignment with the "seam".

Figure 4:
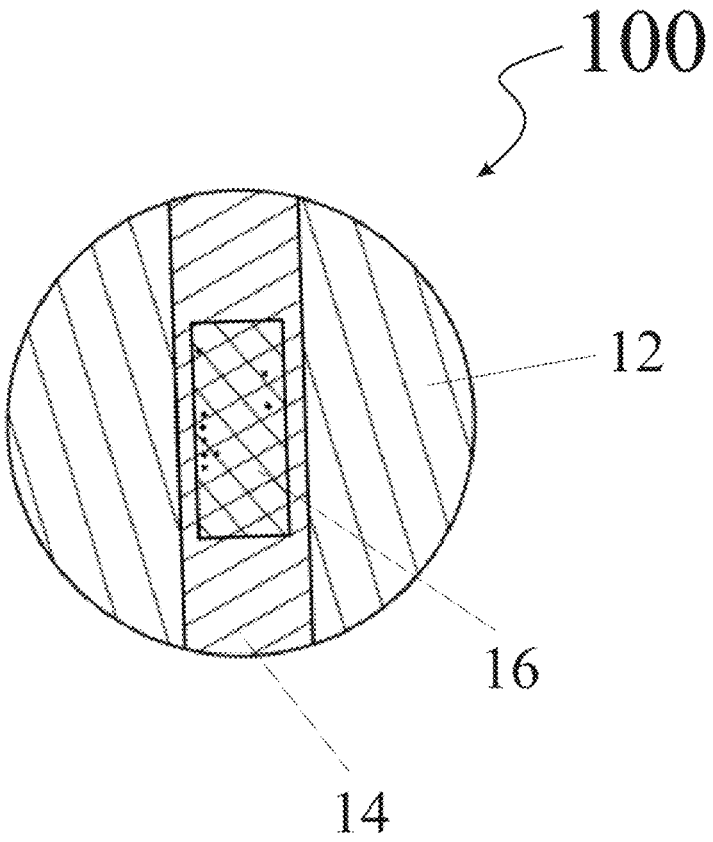
FIG. 4 is an illustrative diagram with the potted material.

FIG. 4 is an illustrative diagram with the potted material.

Figure 5B:
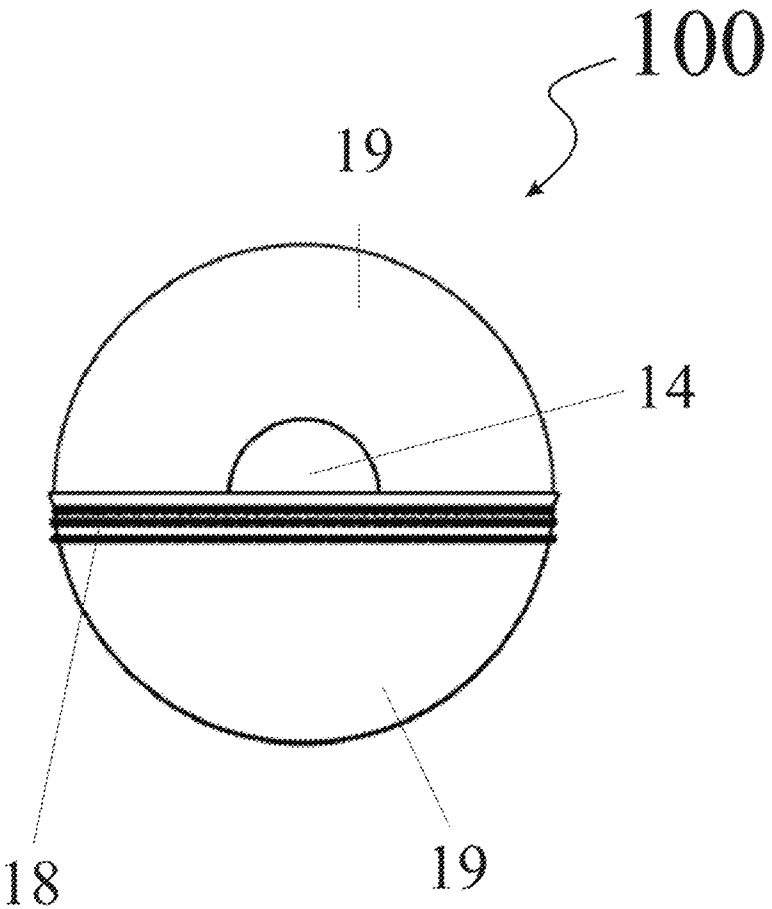
FIG. 5A and FIG. 5B are an illustrative diagram with the leather cups alignment to the cork before stitching the ball.
Figure 5A:
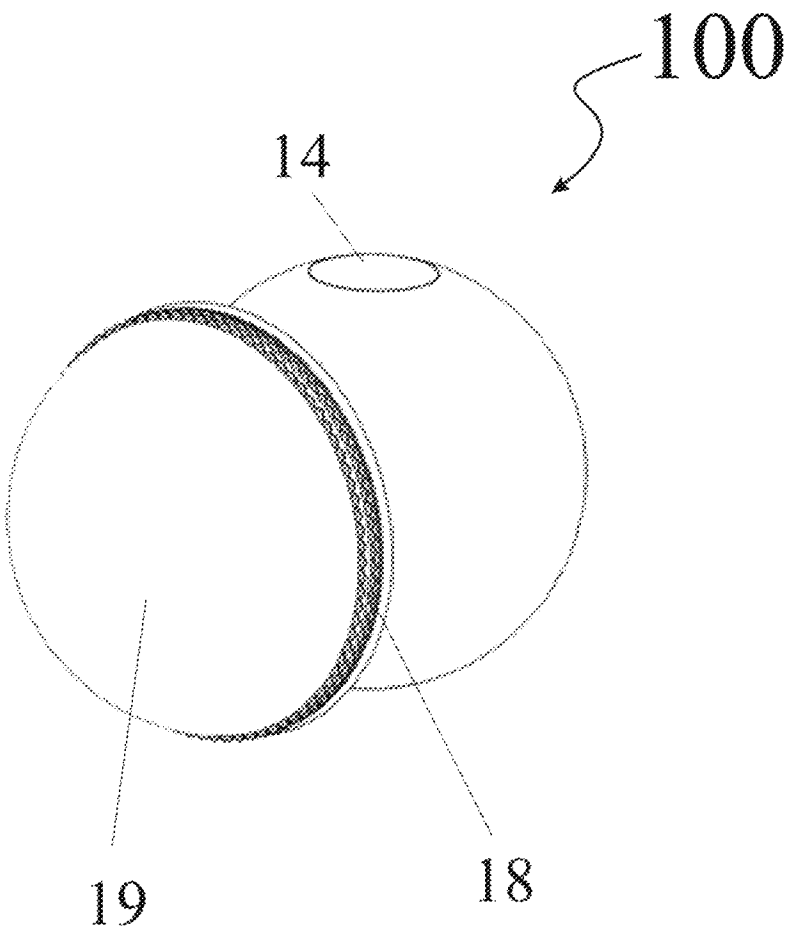

FIGS. 5A and 5B are an illustrative diagram with the leather cups alignment to the cork before stitching the ball.

The specification describes the methodology and configurations used to securely enclose electromechanical components such as processing units and sensors in a sports device with an inner spherical cork filling.

In at least an embodiment, a cricket ball (100) comprises an inner sphere (12) consisting of a cork material. The inner sphere (12) is ensconced within an outer sphere. This outer sphere (19) comprises at least two halves which are stitched together to form a seam (18) so as to completely cover the inner sphere. The inner sphere (12) comprises a cylindrical cavity (14). This cavity is located substantially at the core of the inner sphere (12). Moreover, this cavity is co-axial to the inner sphere (12) as well as the ball, per se. This cavity is, typically, formed by drilling a hole into the cork from an operative top side or an operative bottom side. The outer sphere (19) may be a sphere made up leather. The seam (18), joining these two-half pieces of leather, is a circumferential seam.

In at least an embodiment, a sensor assembly (16) is placed, located substantially, at the centre of said cylindrical cavity (14) along a pre-defined reference plane. This reference plane is by a locus of points wherein said points being collinear points running from a first end of said seam to a second end of said seam (18). This ensures that orthogonal measurements of said sensor assembly (16) are aligned with orthogonal axes of said ball.

A cylindrical cavity (14) is chosen instead of any other shape e.g. cuboid so as to evenly distribute the forces that arise during activity and decrease the stress concentration.

This ensures that the orthogonal measurements of the sensor board are aligned with the orthogonal axes of the physical ball and there are no offsets in alignment.

In at least an embodiment, a charging port is located on the seam (18). The charging port is connected to a battery placed in the cylindrical cavity (14). The battery is connected to the sensor assembly (16).

In at least an embodiment, the sensor assembly (16) is secured in the cavity (14) by means of potting in order to absorb vibrations and thermal shocks, in that, a potting material equivalent in weight to the material removed from said cork by drilling. Typically, the cylindrical cavity (14) is filled with a liquid mix of thermal encapsulant. Property of the potting material is such that the force is not dampened; rather, it is transferred accurately on to the sensor assembly for recordal. Alternatively, the cylindrical cavity (14) is filled with CN8760 that cures over time to become solid silicon.

The sensor assembly (16) is placed in a bore/cavity (14) in the centre of the cork. The board is aligned parallel to the seam (18) making on the cork and then the bore is filled with CN8760 that cures over time to become solid silicon. This embedded cork is used to make a smart cricket ball adhering to the standard ball stitching process thereafter.

In at least an embodiment, the sensor assembly (16) comprises at least a motion-capture mechanism, wherein a first axis of the mechanism passes through the centre of the cylindrical cavity (14), a second axis of said mechanism is perpendicular to the plane defined by the locus of points, and a third axis of the mechanism passes through the centre of the sphere and parallel to said plane defined by the locus of points.

In at least an embodiment, the sensor assembly (16) comprises at least one mechanism selected from a group of mechanisms consisting of accelerometers, gyroscopes, and magnetometers, wherein a first axis of the mechanism passes through the centre of the cylindrical cavity (14), a second axis of the mechanism is perpendicular to the plane defined by the locus of points, and a third axis of said mechanism passes through the centre of said sphere and parallel to the plane defined by the locus of points.

In at least an embodiment, the sensor assembly (16) comprises comprising (or is communicably coupled to) a microcontroller, located within said ball, wherein a first axis of said microcontroller passes through the centre of the cylindrical cavity (14), a second axis of the microcontroller is perpendicular to the plane defined by the locus of points, and a third axis of the microcontroller passes through the centre of the sphere and parallel to the plane defined by the locus of points.

In at least an embodiment, the sensor assembly (16) comprises (or is communicably coupled to) a wireless antenna, located within said ball, wherein a first axis of the antenna passes through the centre of said cylindrical cavity (14), a second axis of the antenna is perpendicular to the plane defined by the locus of points, and a third axis of the antenna passes through the centre of the sphere and parallel to the plane defined by the locus of points.

In at least an embodiment, the sensor assembly (16) comprises (or is communicably coupled to) a memory storage, located within said ball, wherein a first axis of the memory storage passes through the centre of said cylindrical cavity (14), a second axis of the memory storage is perpendicular to the plane defined by the locus of points, and a third axis of the memory storage passes through the centre of the sphere and parallel to the plane defined by the locus of points.

The sensor assembly (16) transmits data from the ball to a remotely located system such as a mobile device or any computational system. The remotely located system collects, packages, and uploads the data to a cloud-based data management and content management and prediction system. The sports device is embedded with a battery-powered motion sensor that transmits filtered data through a wireless radio to a mobile device. The embedded sensor assembly is used to make a smart cricket ball. The sensor board has been embedded into the core cork of the cricket ball and is encapsulated with high density foam without altering the weight and finish of the ball. Filtering algorithms package the data before transmitting it to the mobile device. Preprocessing and transformation occurs on the remotely located system to convert data into a user-understandable format. This data is transmitted to a data and prediction engine that learns and delivers recommendations. The results are visualised and displayed on the remotely located systems and on the web to provide users information about athletic performance and recommendations.

The raw data that is read from the sensor assembly (16) is stored in the memory on the embedded board inside the ball. The data is transmitted via radio/Bluetooth to the remotely locates systems simultaneously as the data reading on a separate thread.

Figure 6:
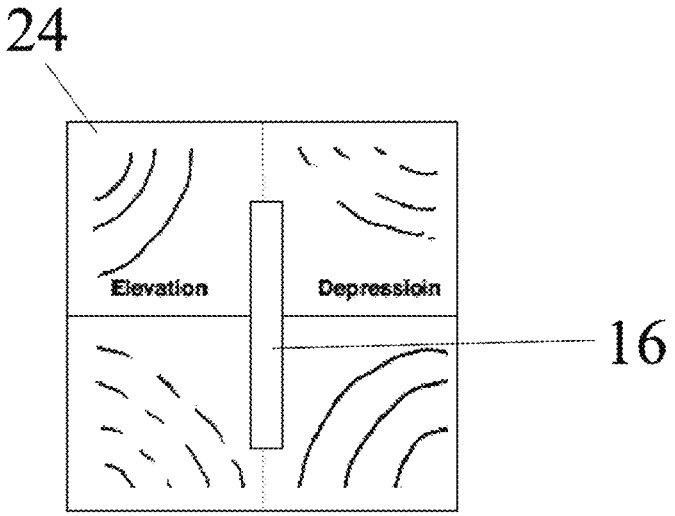
FIG. 6 illustrates a cross-sectional view of a ball, while being placed in a rectangular cavity, with the sensor assembly and forces acting in the ball with respect to the sensor assembly.

FIG. 6 illustrates a cross-sectional view of a ball, while being placed in a cuboid or rectangular cavity (24), with the sensor assembly (16) and forces acting in the ball with respect to the sensor assembly. Here, it can be seen that the material undergoes elevation and depression depending on where force is applied. The translation of the external force towards the sensor is uneven because the forces, while being translated onto the sensor, get converted into elevation forces and depression forces due to the cuboidal construction of the cavity. This, accuracy of sensed data is not guaranteed.

Figure 7:
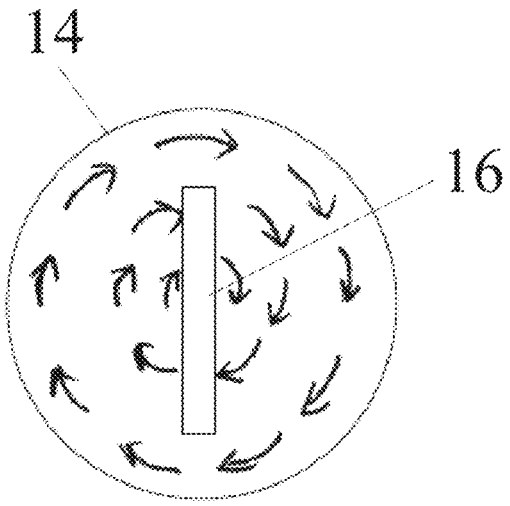
FIG. 7 illustrates a top cross-sectional view of a ball, while being placed in a cylindrical cavity, with the sensor assembly and forces acting in the ball with respect to the sensor assembly.

FIG. 7 illustrates a top cross-sectional view of a ball, while being placed in a cylindrical cavity (14), with the sensor assembly (16) and forces acting in the ball with respect to the sensor assembly. This configuration ensures that forces that act on the exterior of a ball are equally distributed in the cavity which means that translation of the force from the exterior of the ball to the sensor board is accurate. In other words, a cylindrical cavity ensures that the potted material experiences minimal torsional forces and twisting that makes sensor measurement more precise.

In at least an embodiment, the sensor assembly comprises a microcontroller which is communicably coupled with a clock for recording sensed events of the smart ball. This clock is also communicably coupled to another remote sensor—which may be located on a bat or a racquet or any such item which engages with this smart ball. This bat or racquet or any such item, which also has a sensor (remote sensor, in this embodiment), also logs sensed data with respect to itself. Because the smart ball's sensor's clock and the bat's (or racquet's or such item's) sensor is also on the same clock, a synchronised (uniformed) session data is formed of the bat (or racquet) and ball interaction/engagement.

Figure 8:
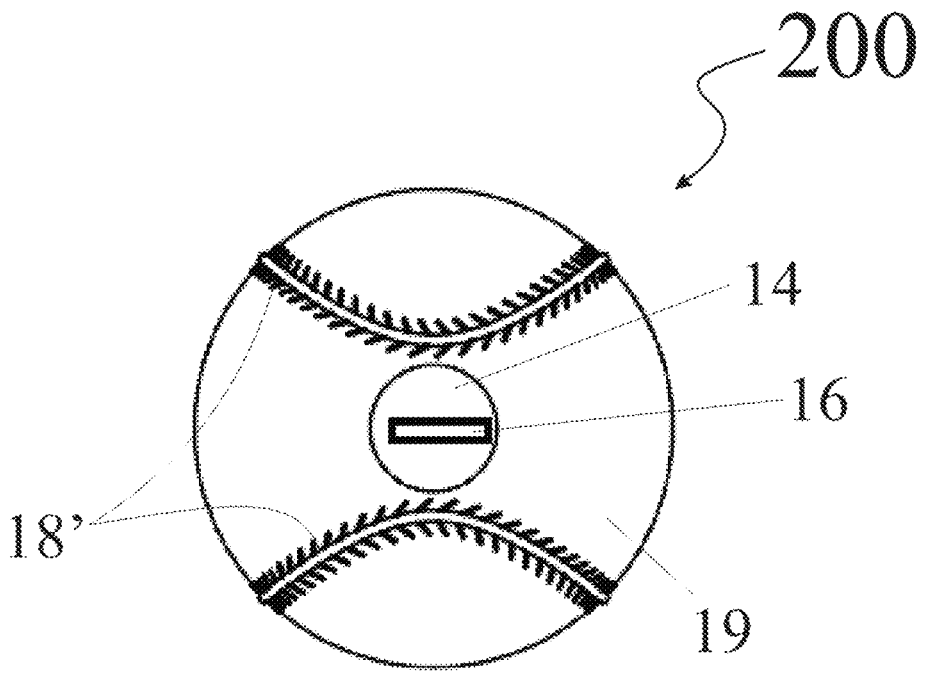
FIG. 8 is an illustrative diagram of a ball, used in baseball, with the cavity shown.

FIG. 8 is an illustrative diagram of a ball (200), used in baseball, with the cavity (14) shown.

Figure 9:
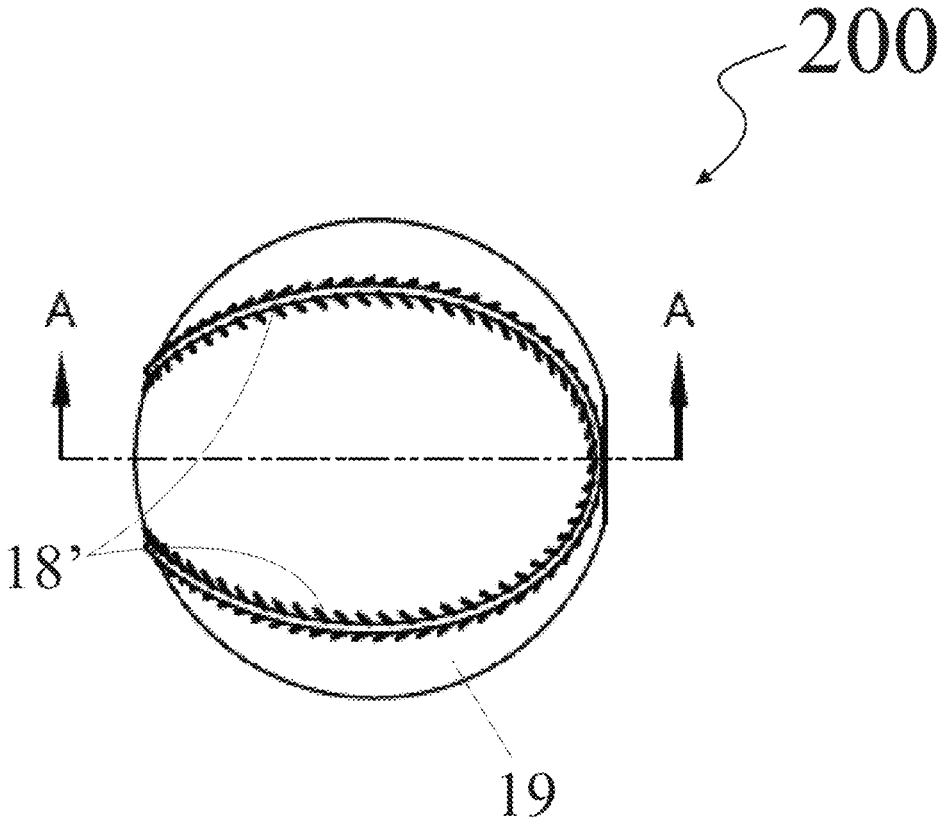
FIG. 9 is an illustrative diagram of a ball, used in baseball, with its two seams.

FIG. 9 is an illustrative diagram of a ball (200), used in baseball, with its two seams (18').

Figure 10:
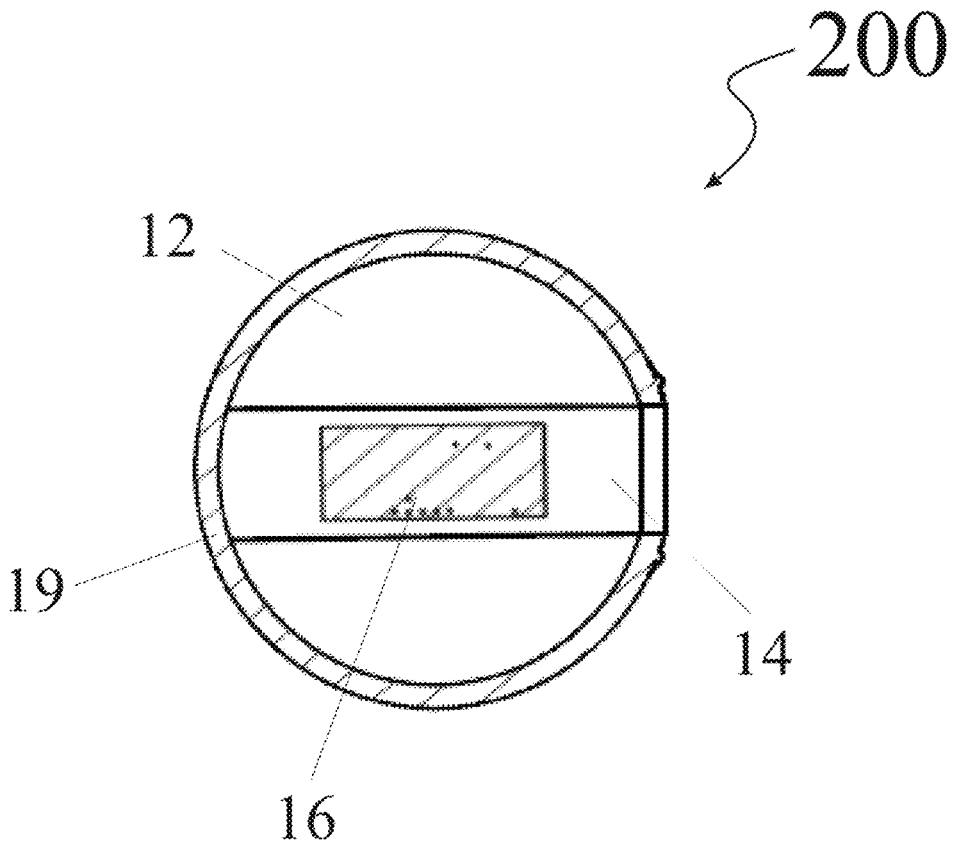
FIG. 10 is an illustrative diagram of a ball, used in baseball, with the sensor assembly embedded in the cavity created in this ball.

FIG. 10 is an illustrative diagram of a ball (200), used in baseball, with the sensor assembly (16) embedded in the cavity (14) created in this ball (200).

In at least an embodiment of this ball (200) that is used in baseball, as illustrated in FIGS. 8, 9, and 10, the sensor assembly (16) is placed, located substantially, at the centre of said cylindrical cavity (14) along a pre-defined reference plane. This reference plane is a plane that divides (along Section A-A as seen in FIG. 9) the two seams in order for them to be equidistant from an imaginary line which form the plane when extended through the mass of the ball. This ensures that orthogonal measurements of said sensor assembly (16) are aligned with orthogonal axes of said ball.

The TECHNICAL ADVANCEMENT of this invention lies in providing a ball with a sensor, in a manner, such that that the rendered ball is an non-legally tampered ball, in that, the positioning of the sensor is extremely accurate, in that, there is no substantial weight gain, as also there is no affect in the nature of the ball, thereby allowing it to be used, seamlessly, in current playing conditions within the defined scope of a game in which this ball is used.

While this detailed description has disclosed certain specific embodiments for illustrative purposes, various modifications will be apparent to those skilled in the art which do not constitute departures from the spirit and scope of the invention as defined in the following claims, and it is to be distinctly understood that the foregoing descriptive matter is to be interpreted merely as illustrative of the invention and not as a limitation.

The invention claimed is:

1. A smart ball comprising:

an inner sphere; and an outer sphere that ensconces said inner sphere, said outer sphere comprising at least two halves stitched together to form a seam so as to completely cover said inner sphere, said inner sphere further comprising:

a cylindrical cavity, running through a central core of said smart ball, said cylindrical cavity formed by drilling into said inner sphere from an operative top side; and a sensor assembly placed, substantially, at the centre of said cylindrical cavity, along a reference plane defined by a locus of points wherein said points being collinear points running from a first portion of said seam to a second portion of said seam, thereby ensuring that orthogonal measurements of said sensor assembly are aligned with orthogonal axes of said smart ball.

2. The smart ball as claimed in claim 1 wherein, a charging port on said seam, said charging port connected to a battery placed in said cylindrical cavity and said battery connected to said sensor assembly.

3. The smart ball as claimed in claim 1 wherein, said inner sphere portion being filled with a cork like material.

4. The smart ball as claimed in claim 1 wherein, said seam circumferentially enveloping said smart ball.

5. The smart ball as claimed in claim 1 wherein, said sensor assembly being secured in said cavity by means of potting, by a potting material, in order to absorb vibrations and thermal shocks, in that, said potting material being equivalent in weight to material that was removed from said inner sphere.

6. The smart ball as claimed in claim 1 wherein, said cylindrical cavity being filled with a liquid mix of thermal encapsulant that cures over time to become solid silicone elastomer.

7. The smart ball as claimed in claim 1 wherein, said cylindrical cavity being filled with solid material selected from a group of materials consisting of high-density foam, rubber, and wood shavings.

8. The smart ball as claimed in claim 1 wherein, said sensor assembly comprising at least a motion-capture mechanism, wherein:

a first axis of said motion-capture mechanism passing through a centre of said cylindrical cavity;

a second axis of said motion-capture mechanism being perpendicular to said reference plane defined by said locus of points; and a third axis of said motion-capture mechanism passing through a centre of said inner sphere and parallel to said reference plane defined by said locus of points.

9. The smart ball as claimed in claim 1 wherein, said sensor assembly comprising at least one mechanism selected from a group of mechanisms consisting of accelerometers, gyroscopes, and magnetometers, wherein:

a first axis of said mechanism passing through a centre of said cylindrical cavity;

a second axis of said mechanism being perpendicular to said reference plane defined by said locus of points; and a third axis of said mechanism passing through a centre of said inner sphere and parallel to said reference plane defined by said locus of points.

10. The smart ball as claimed in claim 1 wherein, said sensor assembly being communicably coupled to a microcontroller, located within said ball, wherein:

a first axis of said microcontroller passing through a centre of said cylindrical cavity;

a second axis of said microcontroller being perpendicular to said reference plane defined by said locus of points; and a third axis of said microcontroller passing through a centre of said inner sphere and parallel to said reference plane defined by said locus of points.

11. The smart ball as claimed in claim 1 wherein, said sensor assembly being communicably coupled to a wireless antenna, located within said ball, wherein:

a first axis of said antenna passing through a centre of said cylindrical cavity;

a second axis of said antenna being perpendicular to said reference plane defined by said locus of points; and a third axis of said antenna passing through a centre of said inner sphere and parallel to said reference plane defined by said locus of points.

12. The smart ball as claimed in claim 1 wherein, said sensor assembly being communicably coupled to a memory storage, located within said ball, wherein:

a first axis of said memory storage passing through a centre of said cylindrical cavity;

a second axis of said memory storage being perpendicular to said reference plane defined by said locus of points; and a third axis of said memory storage passing through a centre of said inner sphere and parallel to said reference plane defined by said locus of points.

13. The smart ball as claimed in claim 1 wherein, said sensor assembly comprising a microcontroller communicably coupled with a clock for recording sensed events, said clock being also communicably coupled to another remote sensor assembly to record said another remote sensor assembly's sensed events with respect to the same clock in order to provide a single-clock session of sensed events comprising data from said ball's sensor assembly in synchronisation with data from said another remote sensor assembly.

14. A smart ball comprising:

an inner sphere; and an outer sphere that ensconces said inner sphere, said outer sphere comprising at least two halves stitched together to form two spaced apart seams so as to completely cover said inner sphere, said inner sphere further comprising:

a cylindrical cavity, running through a central core of said smart ball, said cylindrical cavity formed by drilling into said inner sphere from an operative top side; and a sensor assembly placed, substantially, at the centre of said cylindrical cavity, along a reference plane that divides the two seams in order for them to be equidistant from an imaginary line which form the reference plane when extended through the mass of the ball, thereby ensuring that orthogonal measurements of said sensor assembly are aligned with orthogonal axes of said smart ball, wherein said sensor assembly comprising a microcontroller communicably coupled with a clock for recording sensed events, said clock being also communicably coupled to another remote sensor assembly to record said another remote sensor assembly's sensed events with respect to the same clock in order to provide a single-clock session of sensed events comprising data from said ball's sensor assembly in synchronisation with data from said another remote sensor assembly.

15. The smart ball as claimed in claim 14 wherein, said cylindrical cavity being filled with a liquid mix of thermal encapsulant that cures over time to become solid silicone elastomer.

16. The smart ball as claimed in claim 14 wherein, said sensor assembly comprising at least a motion-capture mechanism, wherein:

a first axis of said motion-capture mechanism passing through a centre of said cylindrical cavity;

a second axis of said motion-capture mechanism being perpendicular to said reference plane; and a third axis of said motion-capture mechanism passing through a centre of said inner sphere and parallel to said reference plane.

17. The smart ball as claimed in claim 14 wherein, said sensor assembly comprising at least one mechanism selected from a group of mechanisms consisting of accelerometers, gyroscopes, and magnetometers, wherein:

a first axis of said mechanism passing through a centre of said cylindrical cavity;

a second axis of said mechanism being perpendicular to said reference plane; and a third axis of said mechanism passing through a centre of said inner sphere and parallel to said reference plane.

18. The smart ball as claimed in claim 14 wherein, said sensor assembly being communicably coupled to a microcontroller, located within said ball, wherein:

a first axis of said microcontroller passing through a centre of said cylindrical cavity;

a second axis of said microcontroller being perpendicular to said reference plane; and a third axis of said microcontroller passing through a centre of said inner sphere and parallel to said reference plane.

19. The smart ball as claimed in claim 14 wherein, said sensor assembly being communicably coupled to a wireless antenna, located within said ball, wherein:

a first axis of said antenna passing through a centre of said cylindrical cavity;

a second axis of said antenna being perpendicular to said reference plane; and a third axis of said antenna passing through a centre of said inner sphere and parallel to said reference plane.

20. The smart ball as claimed in claim 1 wherein, said sensor assembly being communicably coupled to a memory storage, located within said ball, wherein:

a first axis of said memory storage passing through a centre of said cylindrical cavity;

a second axis of said memory storage being perpendicular to said reference plane defined by said locus of points; and a third axis of said memory storage passing through a centre of said inner sphere and parallel to said reference plane defined by said locus of points.

* * * * *